US009851732B2

(12) United States Patent
Englekirk

(10) Patent No.: US 9,851,732 B2
(45) Date of Patent: Dec. 26, 2017

(54) SPLIT POWER SUPPLY BIAS WITH KILL SWITCH

(71) Applicant: PEREGRINE SEMICONDUCTOR CORPORATION, San Diego, CA (US)

(72) Inventor: Robert Mark Englekirk, Pacific Palisades, CA (US)

(73) Assignee: Peregrine Semiconductor Corporation, San Diego, CA (US)

( * ) Notice: Subject to any disclaimer, the term of this patent is extended or adjusted under 35 U.S.C. 154(b) by 530 days.

(21) Appl. No.: 14/601,127

(22) Filed: Jan. 20, 2015

(65) Prior Publication Data

US 2016/0211662 A1 Jul. 21, 2016

(51) Int. Cl.
*G05F 1/56* (2006.01)

(52) U.S. Cl.
CPC ..... *G05F 1/56* (2013.01)

(58) Field of Classification Search
CPC ..... G05F 1/56
USPC ..... 307/35
See application file for complete search history.

(56) References Cited

U.S. PATENT DOCUMENTS 3,519,839 A * 7/1970 Nehez ..... G05F 3/22 257/722
2010/0315157 A1* 12/2010 Na ..... G05F 1/465 327/539
2015/0097534 A1* 4/2015 Bhattad ..... G05F 1/462 323/270
2015/0171731 A1* 6/2015 Tomioka ..... H02M 1/088 307/52

* cited by examiner

*Primary Examiner* — Joseph Chang
(74) *Attorney, Agent, or Firm* — Jaquez Land Greenhaus LLP; Martin J. Jaquez, Esq.; Alessandro Steinfl, Esq.

(57) ABSTRACT

Methods and systems for electrical bias generation are disclosed. Two or more different voltage levels can be created, one above a mid-rail value and one below the mid-rail value for each pair of voltage levels. Such voltage levels can be used to power processes in other circuits by providing a safe but adequate voltage value. Transition control between an on state and an off state for a power supply can also be implemented using this bias generation.

16 Claims, 7 Drawing Sheets

SPLIT POWER SUPPLY BIAS WITH KILL SWITCH

BACKGROUND

1. Field

The present disclosure relates to analog power supplies with a split mid-rail design. More particularly, it relates to split power supply bias with a kill switch.

2. Description of Related Art

Some electrical and electronic components and parts that use a supply voltage with a very wide operating range (for example, 2.3-5.5 V in cellphones) can require a low standby current. A voltage of 5.5 V can be too high to use as a typical cutoff switch in most low voltage processes. Thus, some active circuitry is required to drop this voltage to a more manageable voltage level before cutting off the supply voltage. However, when the supply is at the low end of its operating range (such as 2.3 V), this active circuitry can present excessive impedance and thus also an excessive voltage drop to the main chip because a voltage Vgs (a gate-to-source voltage of a transistor of the switch) to the cutoff switch (transistor) can be much less than 2.3 V due to the voltage limiting circuitry. Typical voltage-limiting circuitry may be similar to either a simple voltage regulator to drop 5.5 V down to within the process limits, or a mid-supply voltage generator which could be, for instance, a resistor divider with (or without) some form of buffering.

In the following, a high voltage of 5.5 V is used as an example to explain some embodiments of the present disclosure. As the person skilled in the art will understand, in other embodiments other voltages, higher or lower than 5.5 V, may be used.

As known to the person skilled in the art, power amplifier circuits (e.g. output stages) are classified as A, B, AB, C, D, etc. for analog designs. In class A amplifiers, 100% of the input signal is used and the active element remains conducting all of the time (i.e. full waveform). In class B amplifiers, 50% of the input signal is used: the active element carries current half of each cycle, and is turned off for the other half. Class AB is intermediate between class A and B, and the two active elements conduct more than half of the time, conducting during one half of the cycle and partially conducting over the other half.

In the case of limiting circuitry taking the form of a simple voltage regulator, the voltage regulator would require a cutoff switch following the regulator, and the mid-rail generator would require two stacked cutoff switches. A possible problem with the regulator is in creating the gate drive to the p-type metal-oxide-semiconductor (PMOS) low drop out (LDO) regulator: the high voltage has to be the high supply, whereas the low voltage side cannot be ground (GND) when the supply voltage (Vdd) is 5.5 V, but ideally wants to be near GND when Vdd is less than a corresponding process voltage limit. This presents significant problems to the design of an operational amplifier (opamp) which drives the LDO, as additional circuitry required to address such problems can use a significant amount of power.

Limiting circuitry taking the form of a mid-supply rail generator can encounter problems similar to that of the voltage regulator: For the mid-supply rail generator two cutoff switches may be required, each with a gate-source on-voltage (Vgs) which can be equal to half the Vdd voltage. For a Vdd of 2.3 V, there can be little overdrive (Vgs-Vt), which can force the use of very large PMOS devices to attain low on resistance (Ron).

The second part of the problem is the output voltage transition. Since Vdd can be greater than the process voltage limit, the voltage swing of the output of the circuit will also be greater than the process voltage. Therefore, the output swing may be too high compared to a safe process voltage. The cutoff switch itself, in that case, may have to be implemented as two distinct devices in series, such as, for example, devices (310, 350) in FIG. 3, and each device cannot exceed the process voltage limit. If both devices don't turn on or off equally, one device could get too much voltage. Some form of transition control is therefore required to ensure that all devices do not exceed their voltage limits. This requirement can apply for both the cutoff switches as well as any pull-down devices designed to null the output voltage.

SUMMARY

In a first aspect of the disclosure, a method to regulate voltage levels is described, the method comprising creating from a supply voltage an above-ground voltage and a below-Vcc voltage, said above-ground voltage being less than the supply voltage and higher than an average of the supply voltage and a ground voltage level, said below-Vcc voltage being less than the average of the supply voltage and a ground voltage level and higher than the ground voltage level; providing at least one load connected to the supply voltage, the above-ground voltage, and the below-Vcc voltage, the at least one load having a process voltage limit; and varying at least one of the above-ground voltage and the below-Vcc voltage, based on at least the process voltage limit.

In a second aspect of the disclosure, a device to regulate a transition between voltage levels is described, the device comprising a voltage regulator component providing a first voltage and a second voltage, the first voltage having a value between a supply voltage and one half of the supply voltage, and the second voltage having a value between one half of the supply voltage and a ground voltage level; a slew rate control component controlling a rate of change of an output voltage; a pull down component to pull down the output voltage; a first logic component to control the slew rate component; and a second logic component to control the pull down component.

In a third aspect of the disclosure, a method to regulate voltage levels is described, the method comprising creating, from a supply voltage, a plurality of voltages including a first, second, third and fourth voltage, said first voltage being less than the supply voltage and higher than two thirds of a difference between the supply voltage and a ground voltage level, said second voltage being less than two thirds of the difference between the supply voltage and the ground voltage level and higher than a third of a difference between the supply voltage and the ground voltage level, said third voltage being less than two thirds of the difference between the supply voltage and the ground voltage level and higher than a third of a difference between the supply voltage and the ground voltage level, said fourth voltage being less than one third of the difference between the supply voltage and the ground voltage level and higher than the ground voltage level; providing at least one load connected to the supply voltage and at least two of the first, second, third and fourth voltages, the at least one load having a process voltage limit; and varying at least one of the at least two voltage, based on at least the process voltage limit.

In a fourth aspect of the disclosure, a method to regulate voltage levels for a stack connected to a supply voltage is disclosed, the method comprising creating from the supply voltage a plurality of N−1 voltage pairs, where N is the number of devices in the stack, each voltage pair of the plurality of voltage pairs including an upper voltage and a lower voltage, the upper voltage of the nth voltage pair, where n is an integer number that ranges from 1 to N−1, being less than (n+1)/N of the supply voltage and higher than n/N of the supply voltage, and the lower voltage level of the nth voltage level difference being less than n/N of the supply voltage and higher than (n−1)/N of the supply voltage; providing the plurality of N−1 voltage pairs to the stack; and varying at least one voltage of the plurality of voltage pairs based on at least a process voltage limit of at least one device of the stack.

BRIEF DESCRIPTION OF DRAWINGS

The accompanying drawings, which are incorporated into and constitute a part of this specification, illustrate one or more embodiments of the present disclosure and, together with the description of example embodiments, serve to explain the principles and implementations of the disclosure.

DETAILED DESCRIPTION

Because creating a simple mid-rail supply can be insufficient, according to various embodiments of the present disclosure two mid-rail supplies are herein designed with special characteristics: One that is designed to be high above ground (GND), and the other is designed to be far below the supply voltage (Vdd, or Vddh), both without exceeding the process voltage limit from their respective supply. At the exemplary high voltage level of 5.5 V, both can act like mid-rail supplies (that is, they each can provide about half the value of 5.5 V), but at low voltage level there can be a greater than Vdd/2 voltage difference between them and their respective supply. This uneven distribution can allow the cutoff switch to operate with about 1.4 V when Vdd=2 V (as opposed to Vdd/2=1 V), and the circuit as a result will begin operation at a much lower supply voltage. This also allows for Vgs-on of the cutoff switches to be 1.4 V; a significant advantage when Vt is about 0.7-0.8 V.

As used herein, the terms "voltage," "voltage level," and "variable voltage level," when not referring to a specific value, are synonymous and refer to an electric potential relative to a ground or baseline potential level, including the variance of the voltage as the source is being turned on or off.

Figure 1:
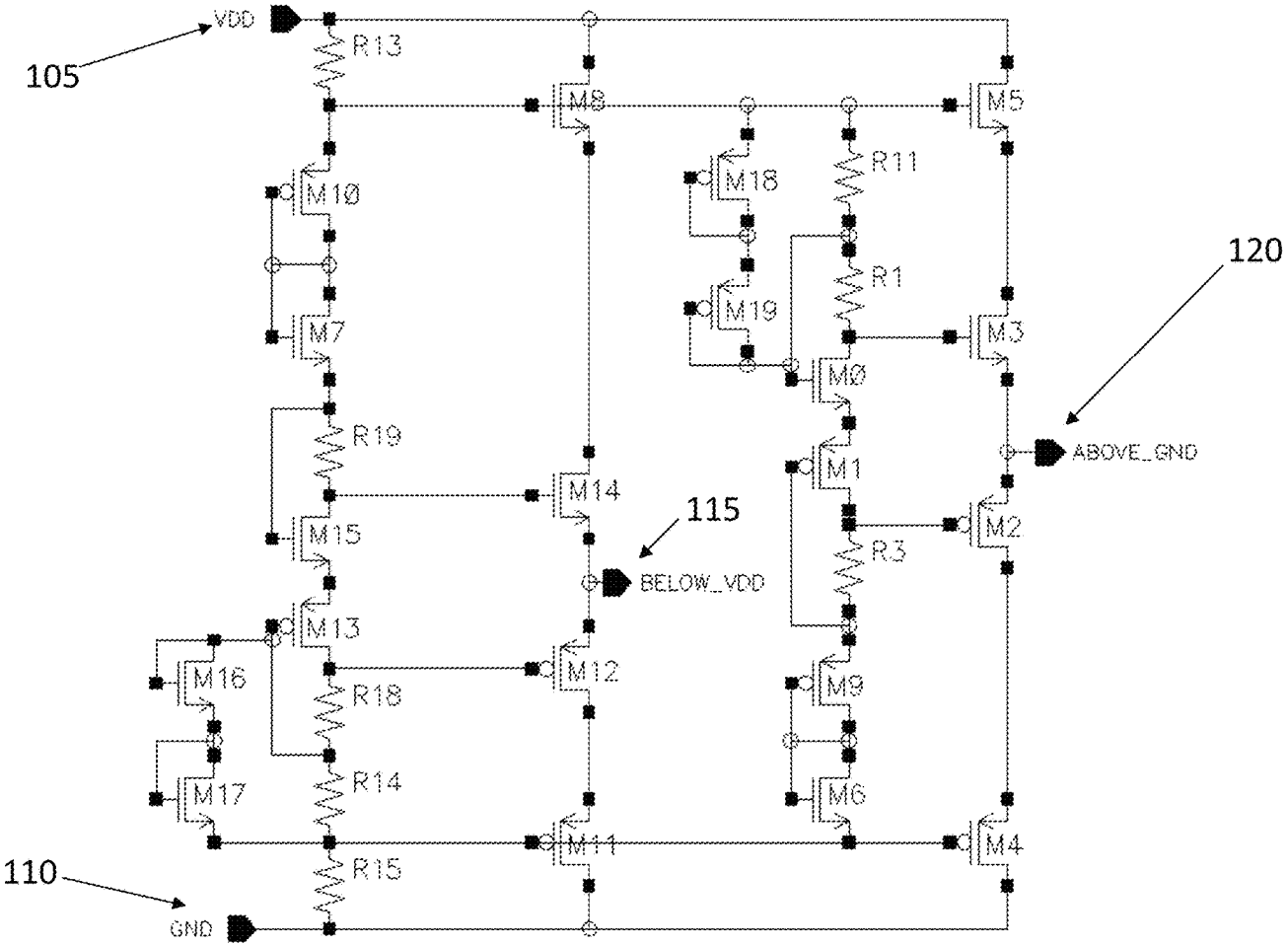
FIG. 1 illustrates an exemplary circuital arrangement according to an embodiment of the present disclosure which can be used to derive an above voltage and a below voltage according to further embodiments of the present disclosure.

FIG. 1 illustrates an example of an embodiment of a dual mid-rail voltage supply of the present disclosure, implemented in this example with complementary metal-oxide semiconductor (CMOS) transistors, which, starting from a voltage level Vdd (105) and ground (110), defines two variable voltage levels 'BELOW_VDD' Vb (115) and 'ABOVE_GND' Va (120). Vb is designed to be a safe mid-rail voltage for when Vdd (105) is high and to have adequate voltage between Vdd (105) and Vb (115) when Vdd (105) is at a minimum. Vdd (105) is high when it has a value closer to its maximum value. For example, in the embodiments described above, a value for Vdd (105) of 5.5 V was used; in these examples, Vdd (105) would be high if closer to 5.5 V than to ground level. Therefore, when Vdd (105) is close to 5.5 V, Vb (115) would have an adequate value as a mid-rail voltage to operate other parts and processes of the device with a safe voltage. When Vdd (105) decreases from its maximum value, Vb (115) will decrease as well but will still provide an adequate voltage to operate other parts and processes of the device with a safe voltage (e.g. smaller than the process voltage limit). As Vdd (105) decreases, it may approach its minimum. The minimum of Vdd can depend on a specific power supply.

Further embodiments may include more than two mid-rail voltage levels, for use for example in the case of a stack of more than two devices to be driven. For example, a stack of three devices in series may utilize three mid-rail voltage levels wherein each can provide about ⅓ of the value of Vdd voltage. In these alternative embodiments, the three (or more) voltage ranges would overlap. For example, to have 3 voltage ranges, one embodiment could implement 4 mid-rail supplies, in order to have a high and low voltage level for each split.

For example, Vdd may be provided by a battery in a cellphone. Vb may be designed to be below Vdd/2, even as Vdd varies. Therefore, Vb is a variable voltage, whose value is adjusted depending on the current value of Vdd and the voltage required by other processes and parts of the device, or other devices, to which Vb is provided to.

According to further embodiments of the present disclosure, Va (120) may be designed to be a safe mid-rail voltage for when Vdd is high with adequate voltage between Va (120) and ground (110) for the case when Vdd is at a minimum voltage level. Va (120) may be designed to be above Vdd/2, even as Vdd varies. Therefore, Va may be a variable voltage, whose value may be adjusted depending on the current value of Vdd and the voltage required by other processes and parts of the device, or other devices to which Va is provided to.

Figure 2:
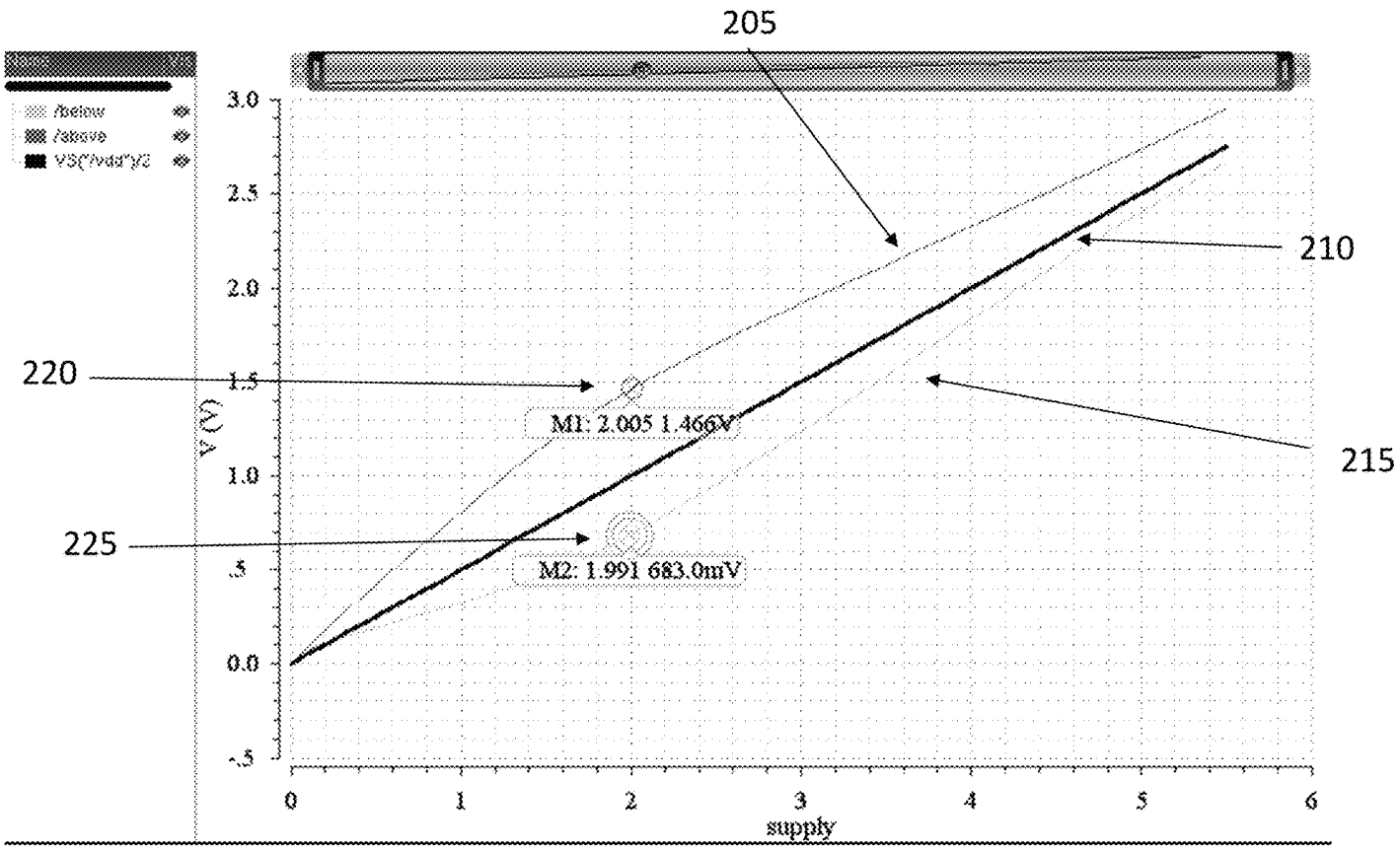
FIG. 2 illustrates exemplary values for the above voltage (Va) and the below voltage (Vb), compared to the Vdd/2 values.

FIG. 2 illustrates exemplary values for Va and Vb. Possible values for Va are plotted (205) as Vdd/2 (210) changes. Vb (215) is also plotted. It can be noted that Va remains above Vdd/2 while Vb is below Vdd/2, and that a relative distance (e.g. voltage difference) between Va and Vdd/2 and between Vb and Vdd/2 is not constant (for example, changes in values of Va and/or Vb may be non-linear with respect to changes in Vdd). In other words, the values of Va and Vb can be varied based on the value of Vdd/2 and the voltage required by the devices coupled to Va and Vb. In FIG. 2, a first exemplary mark (220) reads the voltage value for Va as 1.466 V for a Vdd value of 2.005 V, while a second mark (225) reads the voltage value for Vb as 683.0 mV for a Vdd value of about 2 V.

The ranges for Va and Vb may be overlapping, which can be an advantage in circuit operation and design, especially at low Vdd values. As can be seen on the plot of FIG. 2, such Va and Vb voltages may be a non-linear function of the supply voltage.

A second aspect of the present disclosure is a transition control, i.e., control of the output voltage level as the output voltage varies or is turned on or off. During a transition between an on-state and an off-state, transient voltages present in the circuit may deviate from their prescribed and safe ranges, which can alter a proper operation of the device and therefore damage the device. Therefore, a circuit to control the transition by safely adjusting voltage levels can be advantageous.

Figure 3:
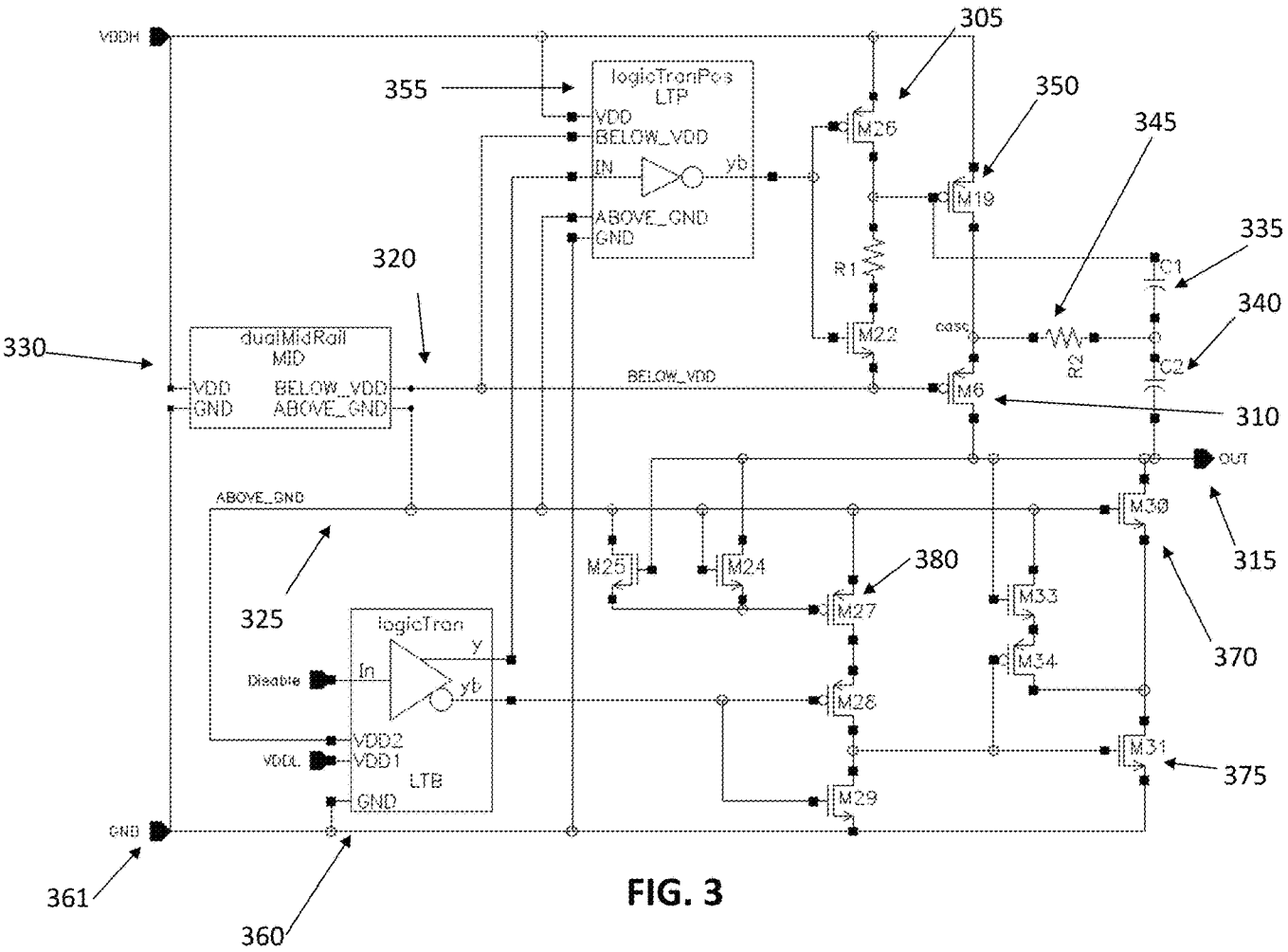
FIG. 3 illustrates an exemplary embodiment for a circuit that carries out transition control according to various embodiments of the present disclosure.

An exemplary embodiment according to the present disclosure for a circuit that carries out transition control is illustrated in FIG. 3. The top right (305) of the diagram of FIG. 3 is the cutoff switch portion of this exemplary design. In the example of FIG. 3, slew rate limiting via miller capacitive feedback can be utilized to control the turn-ON transition speed.

The slew rate is enough to slow the turn-ON of transistor M6 (310) so that its Vds does not exceed the process voltage (limit).

A part of the circuit (330) may provide a voltage below Vdd (320) and a voltage above ground (325), similarly to as discussed regarding FIG. 2, above.

The two capacitors (335, 340) and the resistor (345) can provide a capacitive feedback path to transistor M19 (350), enabling the control of the slew rate for the output voltage (315). Logic blocks (355, 360) can provide logic control for the circuit of FIG. 3.

Transistors M30 (370) and M31 (375) can pull down the output voltage (315).

For the turn-OFF transition, the load is intended to bleed off the voltage until the output gets sufficiently below "ABOVE_GND" (325) to turn on PMOS M27 (380) which in turn activates the pull-down devices M30 (370) and M31 (375). The load devices can be connected between the "out" voltage level (315) and GND (361).

Figure 4:
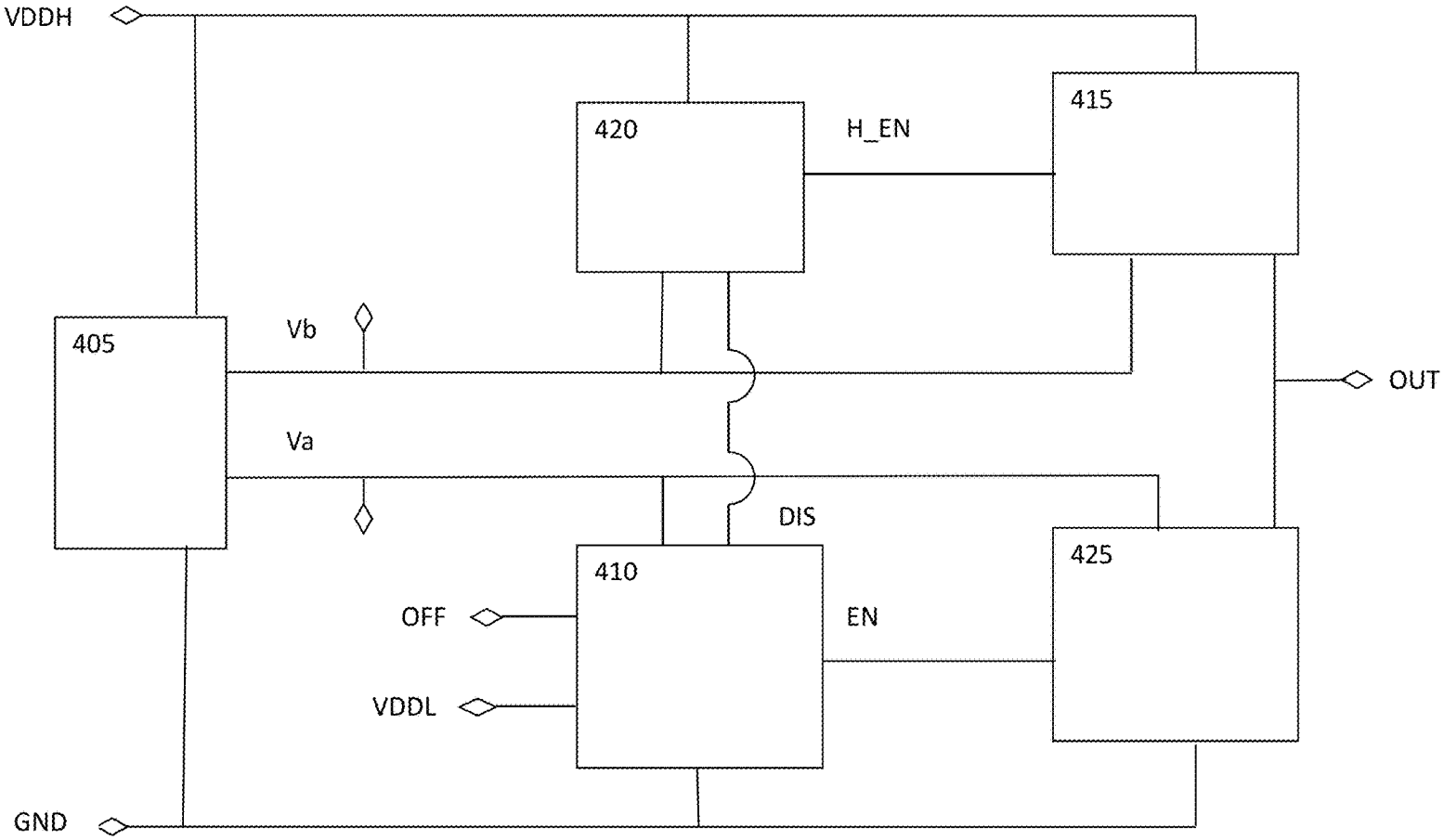
FIG. 4 illustrates a generalized description for a circuit for transition control.

FIG. 4 illustrates a more generalized description for a block diagram of a circuit for transition control.

In FIG. 4, a block diagram of an exemplary transition control circuit is illustrated. A first circuit block (405), or dual mid-rail voltage supply, provides the two (or more) mid-rail voltages, in this example the above-ground voltage (Va) and the below-VDDH voltage (Vb), from an input voltage (VDDH) relative to ground or some fixed low-end reference voltage (GND).

Figure 5:
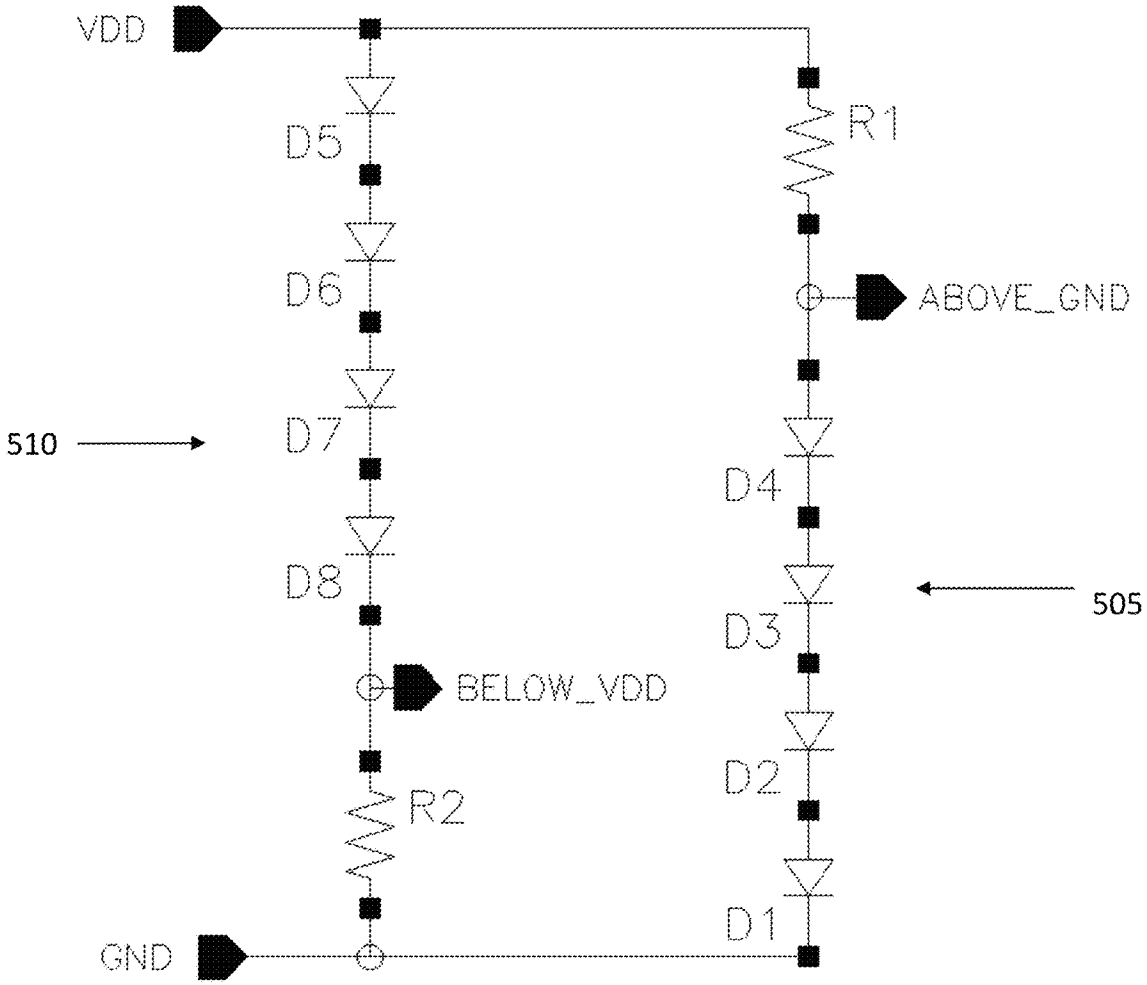
FIG. 5 illustrates an alternate exemplary embodiment of FIG. 1 utilizing resistors and diodes.

The first circuit block (405) may be realized using the circuital arrangement shown in FIG. 1. Other circuital arrangements providing two or more overlapping mid-rail voltages may be used as such arrangements are well known to person skilled in the art. In some embodiments, an alternative design may implement the circuit with diodes and resistors. For example, as illustrated in FIG. 5, Va can be obtained with a plurality of diodes (505) strung above GND voltage with a bias current originating from Vdd. Vb could be obtained with a plurality of diodes (510) strung below Vdd with a bias current originating from GND. An example bias current could be a resistor or current source. Alternatively, a Zener diode could be used, or a voltage limiter or regulator. Each of these current sources would have to limit the respective voltage to be less than the process limit, as well as observe the requirements for the cutoff switch.

A first (410) and second (420) logic module (circuit) may be used to control the transition as described below.

A first logic module (410) may include a power supply (VDDL) which may be independent of VDDH, or may be derived from VDDH. The voltage of VDDL may depend upon the power requirements of the first logic module (410). The logic swing of the disable signal (OFF) matches that of the power supply VDDL. The first logic module (410) reads a disable signal (OFF), i.e. the kill switch, to provide a mid-rail disable output (DIS) to the second logic module (420), and a mid-rail enable output (EN), which may be the inverse of DIS, to a pull-down module (425). The outputs (DIS, EN) activate or deactivate the corresponding modules based on their output values, such that DIS (through the second logic module (420)) causes the pull-up module (415) to become activated at the same time that EN causes the pull-down module (425) to deactivate, and vice versa.

The pull-down module (425) may be configured, when activated by the first logic module (410) by EN and when OUT drops below Va, to pull down OUT to ground (GND) such that OUT does not vary with respect to GND due, for example, to a stored charge.

The second logic module (420), when activated by the first logic module (410) via signal DIS, outputs (H_EN) to the pull-up module (415). Depending on the design of the pull-up module (415), H_EN may be the inverse (e.g. complement) of DIS, as long as H_EN at a low voltage (or ground) will activate the pull-up module (415) and at a high voltage will deactivate the pull-up module (415). With regard to the second logic module (420), Va is the high level logic voltage for the input logic and Vb is the low level logic voltage for the output logic.

The pull-up module (415), when activated by the second logic module (420), applies VDDH (e.g. steady state level) to the output (OUT) at a controlled rate. A sudden application of VDDH to OUT could overload a series of load devices arranged in a stack or as devices (350, 310) within the pull-up module (415), as one device in the stack/module (415) might have nearly the entire voltage of VDDH applied to it at turn-on. The slew rate control allows for the voltages over the load devices of the stack/module (415) to divide evenly among the devices as OUT is being turned on.

Therefore, when the disable signal (OFF) is on (for example, has a voltage applied to it) the pull-down module (425) is activated and the pull-up module (415) is deactivated, thereby setting OUT to GND. Likewise, when the disable signal (OFF) is off (for example, does not have a voltage applied) the pull-down module (425) is deactivated and the pull-up module (415) activates, setting OUT to VDDH. The circuit may also be designed to ensure that the pull-down module (425) and the pull-up module (415) transition occur in a preferred order, so that both modules (415, 425) are not active at the same time during the above-mentioned transitions.

One embodiment of the transition control ensures that, when VDDH is at a low voltage level (Vdd-min, e.g. 2.3 volts), the Vb is as low as possible in order to minimize the voltages across the kill switches (e.g. LDO, 350, 310). When VDDH is at a higher voltage level (Vdd-max, e.g. 5.5 volts), Vb may approach half of VDDH, as that value should already be low enough to provide sufficient voltages for the Vgs of the kill switches, as the circuitry may already be designed for a Vdd-max supply.

Some advantages of the methods and devices according to the various embodiments of the present disclosure described above are as following.

1. There can be very little circuitry that is actually consuming power. Most of the power is dissipated in the mid-rail supply creation, and this circuit can be made to consume very low power assuming Vdd-max is smaller than twice the process voltage. (e.g. 5.5 V<2×3.63 V, i.e. 7.26 V).

2. The operational range can be significantly improved, especially at low voltage.

3. The on impedance can be lower and more predictable, while maintaining a reasonable size for the output devices. If the circuit is implemented in a device where available space is limited, such as in a smartphone, then the size of the circuits may be kept at a minimum or reasonable size.

In some embodiments, the methods that create a mid-rail voltage, together with Va and Vb, as for example in FIG. 1, can be used in the creation of a kill switch for an electronic device, such as for example a cell phone.

Figure 6:
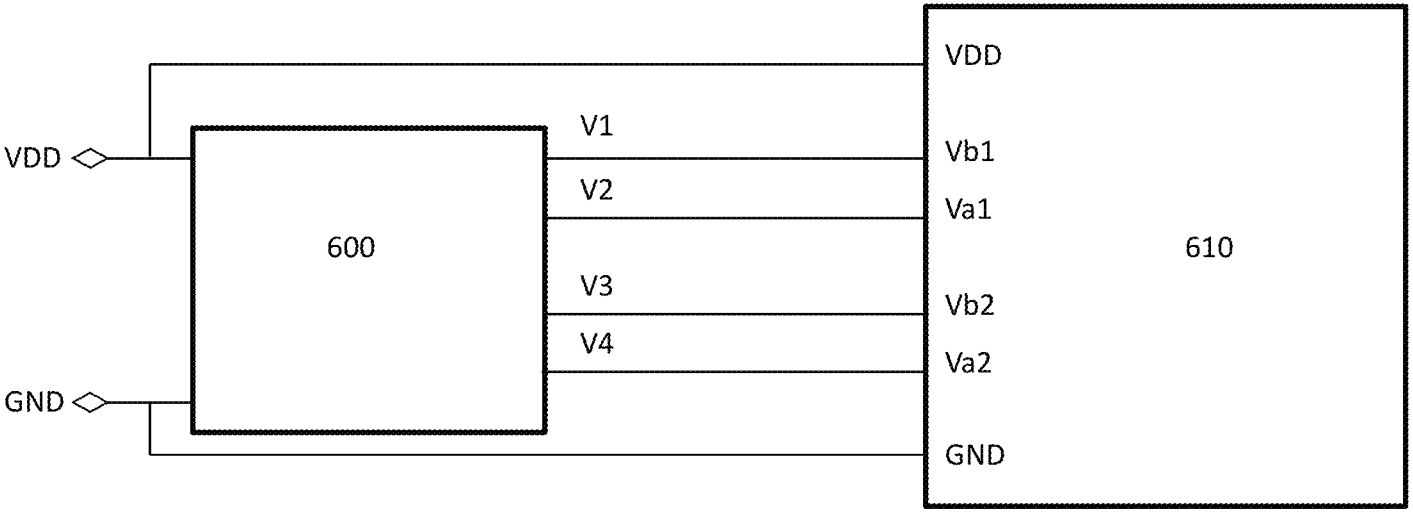
FIG. 6 illustrates an alternate exemplary embodiment of FIG. 1 having four mid-rail voltage levels.
Figure 7:
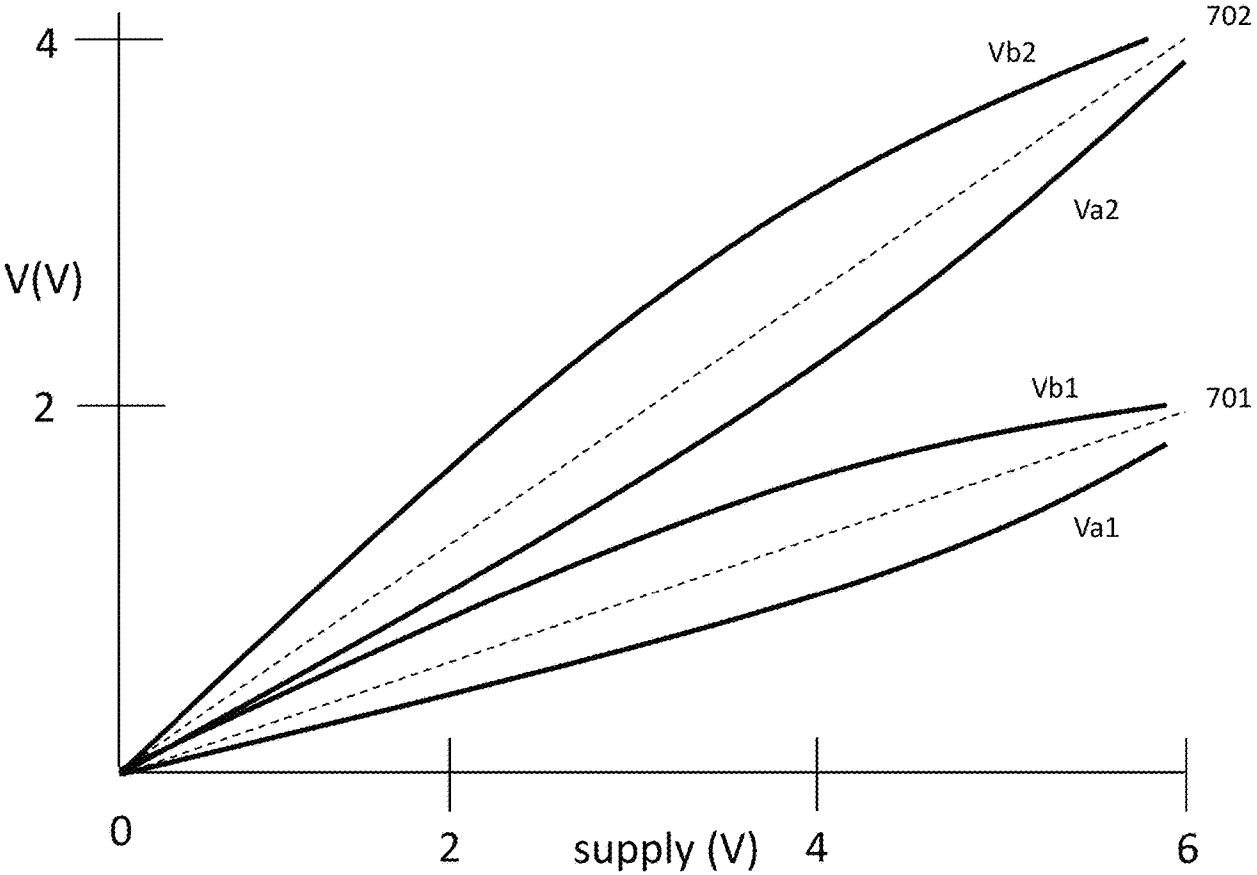
FIG. 7 illustrates a depiction of an exemplary voltage graph for a four mid-rail system.

In some embodiments, the methods of the present disclosure can comprise the generation of multiple voltage levels. For example, instead of two variable voltage levels BELOW_VDD' Vb and 'ABOVE_GND' Va, there could be four or more variable voltage levels, as shown in FIG. 6 and FIG. 7. For the example with four voltages, the mid-rail circuit (600) would have four outputs (V1, V2, V3, V4) provided to a load circuit (610) for a stack of three devices. The first and second voltages (V1, V2) could act as a first Vb and Va pair (Vb1, Va1), and the third and fourth voltages (V3, V4) could act as a second Vb and Va pair (Vb2, Va2), with Vb1 and Va1 approaching around $\frac{1}{3}^{rd}$ of the source voltage (701) and Vb2 and Va2 approaching around ⅔rds the source voltage (702) when the source voltage is near its maximum value. In other embodiments, multiple voltages greater than four may be provided. For example, if a stack of N devices (N being an integer number greater than 1), there could be N−1 voltage pairs, each voltage pair consisting of two voltages that act as a Vb and Va that approach a value of n/N of the source voltage when the source voltage is near its maximum value (n being the range of integers between 1 and N−1, indicating which voltage pair of the N−1 voltage pairs is being discussed). In this example, the upper voltage of the nth voltage pair would be less than (n+1)/N of the supply voltage and higher than n/N of the supply voltage, and the lower voltage level of the nth voltage level difference would be less than n/N of the supply voltage and higher than (n−1)/N of the supply voltage (0/N of the supply voltage being equal to the ground reference potential). In some embodiments, each of the multiple voltage levels remains bound by the adjacent values. For examples, for the case of four voltages, the four levels are variable however their values could remain limited by the adjacent levels, that is: V1<V2<V3<V4. In some embodiments, the multiple voltage levels may be bound to specific values as well. For example, with four voltage levels, V1 may be bound to be between the power supply level VDD level and two thirds of the voltage difference between the supply voltage level and ground level; V2 and V3 may be bound between two thirds and one third of the voltage difference between the supply voltage levels and ground level; V4 may be bound between one third of the voltage difference between the supply voltage levels and the ground level, and ground level. Although, in this example, V2 and V3 are within the same upper and lower bounds, the difference is that V2 and V3 vary in a different way as the supply level changes. For example, V2 may be closer to its upper boundary value when the supply voltage is high, and may tend to decrease when the supply voltage decreases. On the other hand, V3 may be close to its lower boundary value, and tend to decrease when the supply voltage decreases. In some embodiments, V2 is always higher than V3.

A number of embodiments of the disclosure have been described. Nevertheless, it will be understood that various modifications may be made without departing from the spirit and scope of the present disclosure. Accordingly, other embodiments are within the scope of the following claims.

The examples set forth above are provided to those of ordinary skill in the art as a complete disclosure and description of how to make and use the embodiments of the disclosure, and are not intended to limit the scope of what the inventor/inventors regard as their disclosure.

Modifications of the above-described modes for carrying out the methods and systems herein disclosed that are obvious to persons of skill in the art are intended to be within the scope of the following claims. All patents and publications mentioned in the specification are indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A method to regulate voltage levels comprising:

creating from a supply voltage an above-ground voltage and a below-Vcc voltage, said above-ground voltage being less than the supply voltage and higher than an average of the supply voltage and a ground voltage level, said below-Vcc voltage being less than the average of the supply voltage and a ground voltage level and higher than the ground voltage level;

providing at least one load connected to the supply voltage, the above-ground voltage, and the below-Vcc voltage, the at least one load having a process voltage limit; and varying at least one of the above-ground voltage and the below-Vcc voltage, based on at least the process voltage limit.

2. The method of claim 1, further comprising slewing a rate at which the supply voltage is applied to the at least one load during a turn on operation.

3. The method of claim 1, further comprising pulling down the at least one load to the ground voltage level during a turn off operation.

4. The method of claim 1, further comprising slewing a rate at which the supply voltage is applied to the at least one load during a turn on operation and pulling down the at least one load to the ground voltage level during a turn off operation.

5. The method of claim 4, further comprising controlling, via logic circuits, the slewing and the pulling down.

6. The method of claim 1, wherein the above-ground voltage and the below-Vcc voltage vary in a non-linear manner with respect to changes in the supply voltage.

7. A device comprising circuitry arranged to perform the method of claim 6 when in operation.

8. A device comprising circuitry arranged to perform the method of claim 1 when in operation.

9. A device to regulate a transition between voltage levels comprising:

a voltage regulator component providing a first voltage and a second voltage, the first voltage having a value between a supply voltage and one half of the supply voltage, and the second voltage having a value between one half of the supply voltage and a ground voltage level;

a slew rate control component controlling a rate of change of an output voltage;

a pull down component to pull down the output voltage;

a first logic component to control the slew rate component; and a second logic component to control the pull down component.

10. The device of claim 9, wherein the slew rate control component comprises a plurality of capacitors, resistors and complementary metal-oxide semiconductor (CMOS) transistors.

11. The device of claim 10, wherein the plurality of capacitors, resistors and CMOS transistors comprises two capacitors and two resistors forming a capacitive feedback path.

12. The device of claim 9, wherein an input of the first logic component is connected to an output of the second logic component.

13. A device to regulate a transition between voltage levels comprising:

a source voltage input;

a ground voltage connection;

a dual mid-rail voltage supply connected to the source voltage input and the ground voltage connection and outputting a below-source voltage and an above-ground voltage;

a first logic circuit connected to the above-ground voltage and the ground voltage connection and outputting a first logic output and a second logic output, the first logic output being the inverse of the second logic output;

a second logic circuit connected to the source voltage input, the below-source voltage, the above-ground voltage, and the ground voltage connection and outputting a third logic output;

a slew rate control circuit connected to the source voltage, the third logic output, and the below-source voltage and comprising at least two switches; and a pull-down circuit connected to the second logic output, the ground voltage connection, the above-ground voltage, and the slew rate control circuit.

14. A method to regulate voltage levels comprising:

creating, from a supply voltage, a plurality of voltages including a first, second, third and fourth voltage, said first voltage being less than the supply voltage and higher than two thirds of a difference between the supply voltage and a ground voltage level, said second voltage being less than two thirds of the difference between the supply voltage and the ground voltage level and higher than a third of a difference between the supply voltage and the ground voltage level, said third voltage being less than two thirds of the difference between the supply voltage and the ground voltage level and higher than a third of a difference between the supply voltage and the ground voltage level, said fourth voltage being less than one third of the difference between the supply voltage and the ground voltage level and higher than the ground voltage level;

providing at least one load connected to the supply voltage and at least two of the first, second, third and fourth voltages, the at least one load having a process voltage limit; and varying at least one of the at least two voltage, based on at least the process voltage limit.

15. The method to regulate voltage levels of claim 14, wherein the third voltage is lower than the second voltage.

16. A method to regulate voltage levels for a stack connected to a supply voltage, the method comprising:

creating from the supply voltage a plurality of N−1 voltage pairs, where N is the number of devices in the stack, each voltage pair of the plurality of voltage pairs including an upper voltage and a lower voltage, the upper voltage of the nth voltage pair, where n is an integer number that ranges from 1 to N−1, being less than (n+1)/N of the supply voltage and higher than n/N of the supply voltage, and the lower voltage level of the nth voltage level difference being less than n/N of the supply voltage and higher than (n−1)/N of the supply voltage;

providing the plurality of N−1 voltage pairs to the stack; and varying at least one voltage of the plurality of voltage pairs based on at least a process voltage limit of at least one device of the stack.

* * * * *